US011761695B2

(12) United States Patent
Si et al.

(10) Patent No.: US 11,761,695 B2
(45) Date of Patent: Sep. 19, 2023

(54) REFRIGERATION SYSTEM AND THROTTLE CONTROL METHOD THEREFOR

(71) Applicant: Carrier Corporation, Palm Beach Gardens, FL (US)

(72) Inventors: Shaojuan Si, Shanghai (CN); Haiping Ding, Shanghai (CN); Michael Stark, Mooresville, NC (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/718,909

(22) Filed: Apr. 12, 2022

(65) Prior Publication Data

US 2022/0243967 A1 Aug. 4, 2022

Related U.S. Application Data

(62) Division of application No. 15/778,559, filed as application No. PCT/US2016/059895 on Nov. 1, 2016, now Pat. No. 11,365,916.

(30) Foreign Application Priority Data

Nov. 25, 2015 (CN) ..... 201510830326.1

(51) Int. Cl.
*F25B 49/02* (2006.01)
*F25B 41/34* (2021.01)
(Continued)

(52) U.S. Cl.
CPC ..... *F25B 41/34* (2021.01); *F25B 41/20* (2021.01); *F25B 41/31* (2021.01); *F25B 41/385* (2021.01);
(Continued)

(58) Field of Classification Search
CPC ..... F25B 2700/04; F25B 2600/2513; F25B 2400/13; F25B 49/02; F25B 41/20; F25B 41/385
See application file for complete search history.

(56) References Cited

U.S. PATENT DOCUMENTS 4,062,199 A 12/1977 Kasahara et al.
5,431,026 A 7/1995 Jaster
(Continued)

FOREIGN PATENT DOCUMENTS

CN 202928232 U 5/2013
CN 20398540 U 11/2013
(Continued)

OTHER PUBLICATIONS

Chinese Office Action for application CN 201510830326.1, dated Jan. 2, 2020, 7 pages.
(Continued)

*Primary Examiner* — Nael N Babaa
(74) *Attorney, Agent, or Firm* — CANTOR COLBURN LLP

(57) ABSTRACT

A refrigeration system, comprising a compressor, a condenser, a throttle flow path, and an evaporator connected in sequence, wherein a non-adjustable main throttle element is disposed in the throttle flow path; and further comprising a bypass flow path, wherein the bypass flow path is connected to the throttle flow path respectively at the upstream and downstream of the main throttle element, and provided with an adjustable auxiliary throttle element thereon; a liquid level sensor, disposed upstream and/or downstream of the throttle flow path, and configured to detect the liquid level; and a controller, wherein the controller is configured to control the opening of the auxiliary throttle element according to a liquid level signal from the liquid level sensor.

12 Claims, 4 Drawing Sheets

(51) Int. Cl.
*F25B 41/385* (2021.01)
*F25B 41/31* (2021.01)
*F25B 41/20* (2021.01)

(52) U.S. Cl.
CPC ..... *F25B 49/02* (2013.01); *F25B 2400/13* (2013.01); *F25B 2600/2513* (2013.01); *F25B 2700/04* (2013.01)

(56) References Cited

U.S. PATENT DOCUMENTS

| | | | |
|---|---|---|---|
| 5,435,145 | A | 7/1995 | Jaster |
| 5,771,700 | A | 6/1998 | Cochran et al. |
| 6,050,098 | A | 4/2000 | Meyer |
| 6,266,964 | B1 | 7/2001 | Meyer |
| 6,422,310 | B2 | 7/2002 | Egara |
| 6,637,226 | B2 | 10/2003 | Watanabe |
| 7,178,362 | B2 | 2/2007 | Collings |
| 7,987,681 | B2 | 8/2011 | Cochran |
| 8,136,364 | B2 | 3/2012 | Lifson |
| 8,474,276 | B2 | 7/2013 | Nelson |
| 8,516,841 | B2 | 8/2013 | Wittmann et al. |
| 8,801,893 | B2 | 8/2014 | Brillhart |
| 8,931,288 | B2 | 1/2015 | Qu |
| 9,038,404 | B2 | 5/2015 | Judge |
| 2005/0086950 | A1 | 4/2005 | Khatri |
| 2005/0247071 | A1 | 11/2005 | Nemit |
| 2006/0059926 | A1 | 3/2006 | McCormick et al. |
| 2007/0056282 | A1 | 3/2007 | Iwaszkiewicz |
| 2009/0199656 | A1 | 8/2009 | Kumar |
| 2009/0320506 | A1 | 12/2009 | Lifson et al. |
| 2010/0251750 | A1 | 10/2010 | Lifson et al. |
| 2011/0000234 | A1 | 1/2011 | Nishimura et al. |
| 2013/0145783 | A1 | 6/2013 | Hong et al. |
| 2014/0123698 | A1 | 5/2014 | Zhang et al. |
| 2015/0007599 | A1 | 1/2015 | Sugiyama |
| 2015/0168036 | A1 | 6/2015 | Goel et al. |
| 2016/0146516 | A1 | 5/2016 | Liu |
| 2016/0375745 | A1 | 12/2016 | Duerr et al. |

FOREIGN PATENT DOCUMENTS

| | | | |
|---|---|---|---|
| CN | 103727695 | A | 4/2014 |
| CN | 104345743 | A | 2/2015 |
| CN | 104792072 | A | 7/2015 |
| EP | 1207359 | A2 | 5/2002 |
| EP | 2589899 | A1 | 5/2013 |

OTHER PUBLICATIONS

Chinese Office Action for Application No. 201510830326.1; dated Dec. 9, 2020; 8 Pages.

International Search Report and Written Opinion for application PCT/US2016/059895, dated Feb. 13, 2017, 13 pages.

REFRIGERATION SYSTEM AND THROTTLE CONTROL METHOD THEREFOR

CROSS-REFERENCE TO RELATED APPLICATIONS

This application is a divisional of U.S. patent application Ser. No. 15/778,559, filed May 23, 2018, which is a 371 U.S. National Stage application of PCT/US2016/059895, filed Nov. 1, 2016, which claims priority to Chinese Patent Application No. 201510830326.1, filed Nov. 25, 2015, the entire contents of which are incorporated herein by reference.

TECHNICAL FIELD

The present invention relates to control of a refrigeration system, and particularly to a throttle control method for a refrigeration system.

BACKGROUND

As shown in FIG. 1, a conventional refrigeration system includes a compressor, a condenser 200, an economizer 400, an evaporator 300 and a throttle element. The throttle element is arranged between the condenser 200 and the economizer 400, which plays an irreplaceable role as a component that provides expansion throttle for the refrigerant. Various types of throttle elements exist, including electronic expansion valves and thermal expansion valves that can be adapted to different extents of throttle demand by adjusting the opening, and capillary tubes and throttle orifice plates having a fixed throttle effect.

Among the throttle elements mentioned above, because throttle orifice plates 110 and 120 can be directly installed in a pipeline, the processing is quite convenient, the cost is moderate, and the performance is stable. Therefore, the throttle orifice plates are generally considered to be used preferentially in a class of prior art refrigeration systems. However, the throttle effect is non-adjustable, and thus the type of the throttle orifice plate has to be selected according to a set working condition. Once the type is selected, it means that the throttle extent of the refrigeration system is determined. In this case, if a working condition of low pressure height and high flow rate occurs in the refrigeration system, the throttle area of the selected throttle orifice plate is difficult to meet the demand. Therefore, it is necessary to solve the problem regarding the adjustability of the throttle area of the refrigeration system employing a throttle orifice plate while the cost, stability, and other performances are taken into accounted.

SUMMARY

An objective of the present invention is to provide a refrigeration system having a throttle flow path with non-adjustable throttle effect and an auxiliary flow path with adjustable throttle effect.

Another objective of the present invention is to provide a throttle control method for a refrigeration system having a throttle flow path with non-adjustable throttle effect and an auxiliary flow path with adjustable throttle effect.

To achieve the above or other objectives, the present invention provides the following technical solutions.

According to an aspect of the present invention, a refrigeration system is provided, including a compressor, a condenser, a throttle flow path, and an evaporator connected in sequence, where a non-adjustable main throttle element is disposed in the throttle flow path; further including a bypass flow path, wherein the bypass flow path is connected to the throttle flow path respectively at the upstream and downstream of the main throttle element, and provided with an adjustable auxiliary throttle element thereon; a liquid level sensor, disposed upstream and/or downstream of the throttle flow path, and configured to detect the liquid level; and a controller, wherein the controller is configured to control the opening of the auxiliary throttle element according to a liquid level signal from the liquid level sensor.

According to another aspect of the present invention, a throttle control method for the refrigeration system described above is further provided, including S100: receiving a liquid level signal from a liquid level sensor; S200: comparing the liquid level signal with a preset value of the system, and outputting a control signal; and S300: controlling the opening of an auxiliary throttle element according to the control signal.

DETAILED DESCRIPTION OF THE EMBODIMENTS

Figure 1:
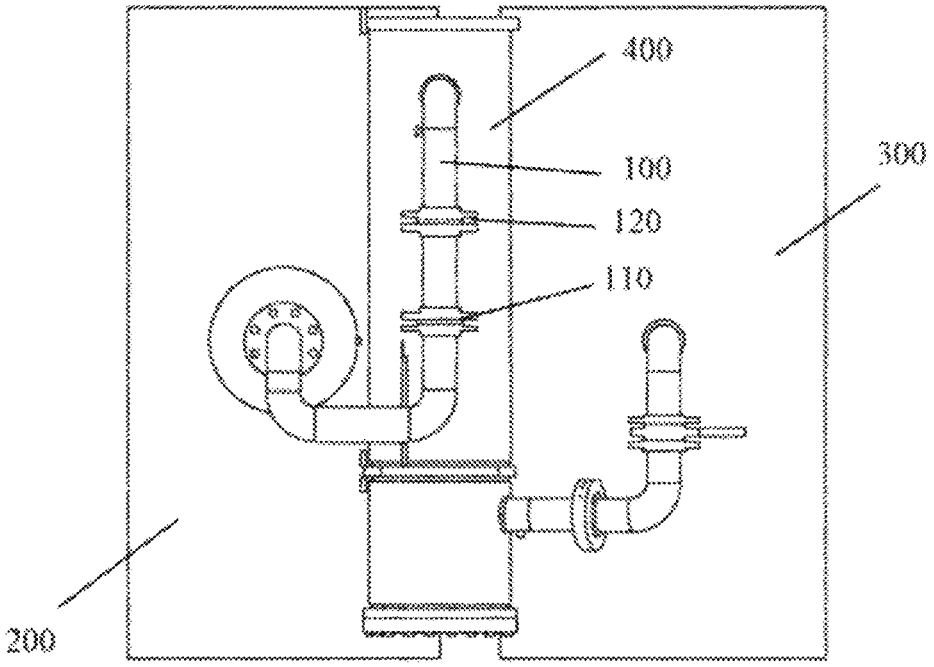
Fig. 1 PRIOR ART
FIG. 1 is a schematic diagram of a part of a refrigeration system in the prior art.
Figure 2:
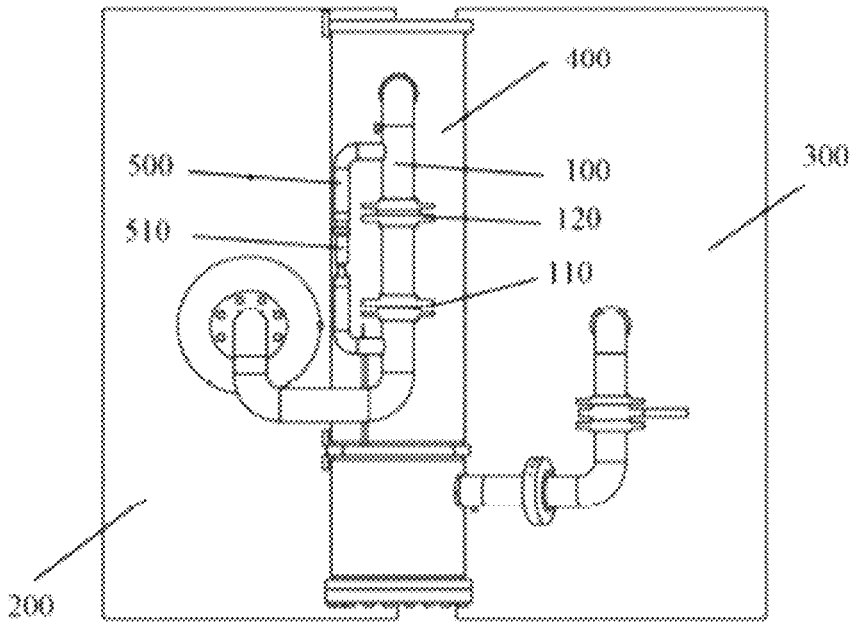
FIG. 2 is a schematic diagram of a part of a refrigeration system according to an embodiment of the present invention.
Figure 3:
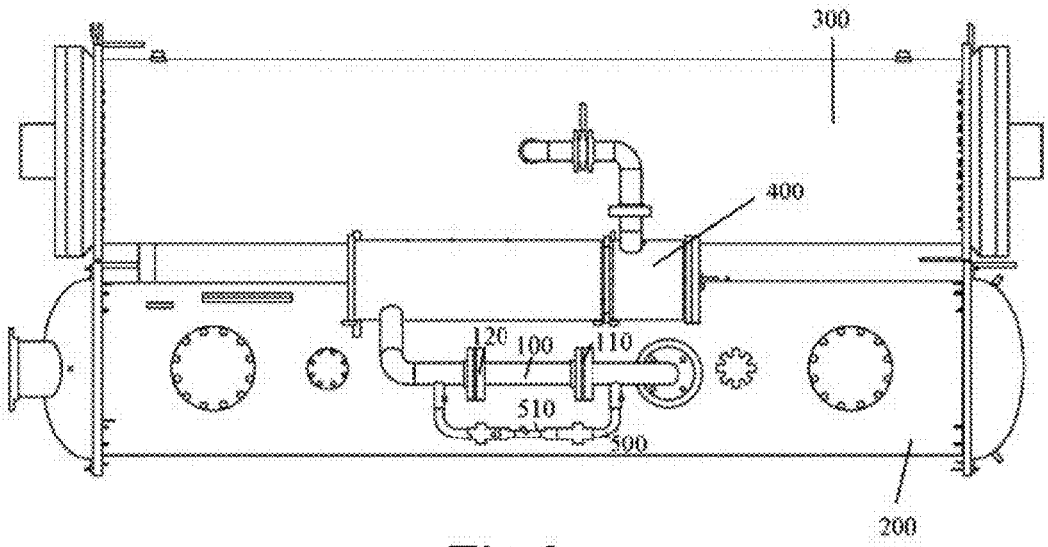
FIG. 3 is a schematic diagram showing the arrangement of a refrigeration system according to an embodiment of the present invention.

FIGS. 2 and 3 show an embodiment of a refrigeration system of the present invention. The refrigeration system includes a compressor, a condenser 200, a throttle element, an economizer 400 and an evaporator 300 connected by a tube in sequence. A throttle flow path 100 is disposed between the condenser 200 and the economizer 400, and one end of the throttle flow path 100 is connected to an outlet of the condenser 200, and the other end is connected to an inlet of the economizer 400. A non-adjustable main throttle element is disposed in the throttle flow path. Further, the refrigeration system also includes a bypass flow path 500, which is connected to the throttle flow path 100 respectively at the upstream and downstream of the main throttle element, and provided with an adjustable auxiliary throttle element therein. The adjustable auxiliary throttle element will be opened where appropriate, to provide an additional and adjustable throttle area for the refrigeration system.

Although not shown in the figure, it should be known to a person of skill in the art that the refrigeration system should further has a controller (e.g., a microprocessor-based controller), which is configured to control the opening of the auxiliary throttle element according to various control instructions. For example, a liquid level sensor may be disposed upstream and/or downstream of the throttle flow path 100 in the refrigeration system; and the controller can control the opening of the auxiliary throttle element according to a liquid level signal transmitted from the liquid level sensor. Although the refrigeration system already has a rated working condition and a throttle area corresponding to the rated working condition, by means of the design in the present invention, the refrigeration system is enabled to further have a adjustability in a large throttle area in processing the working condition of low pressure height and high flow rate and others, thus improving the scope of application of the refrigeration system.

In this embodiment, the non-adjustable main throttle element is an orifice plate. More specifically, to improve the throttle effect, a first orifice plate 110 and a second orifice plate 120 are disposed in sequence from upstream to downstream in this embodiment. Optionally, it is found according to the experiment results that when an arrangement of double throttle orifice plates is employed, in order to achieve a better throttle effect, it should be taken in mind that the numerical value of the distance between the first orifice plate 110 and the second orifice plate 120 should be about three times and preferably three times of the numerical value of the tube diameter of the throttle flow path.

In this embodiment, the adjustable auxiliary throttle element is an electronic expansion valve 510, which is a typical adjustable throttle element and has a high work reliability.

Optionally, although in the embodiment of two-stage refrigeration system as shown in FIG. 2 and FIG. 3, the throttle flow path is arranged between the condenser 200 and the economizer 400, the throttle flow path may also be arranged between the economizer 400 and the evaporator 300. In addition, when used in a one-stage refrigeration system having no economizer, the throttle flow path can also be practically arranged between the condenser 200 and the evaporator 300. In this manner, the effect anticipated in the present invention can also be achieved.

Figure 4:
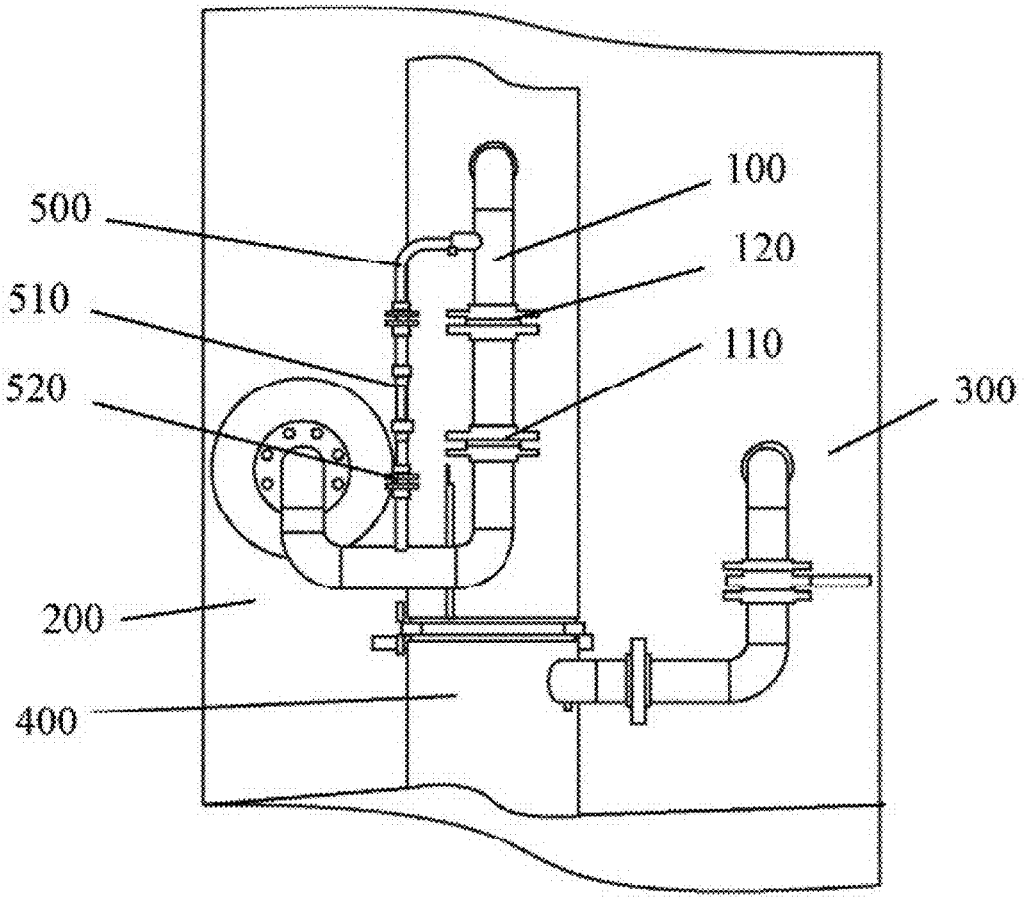
FIG. 4 is a schematic diagram of a part of a refrigeration system according to another embodiment of the present invention.
Figure 5:
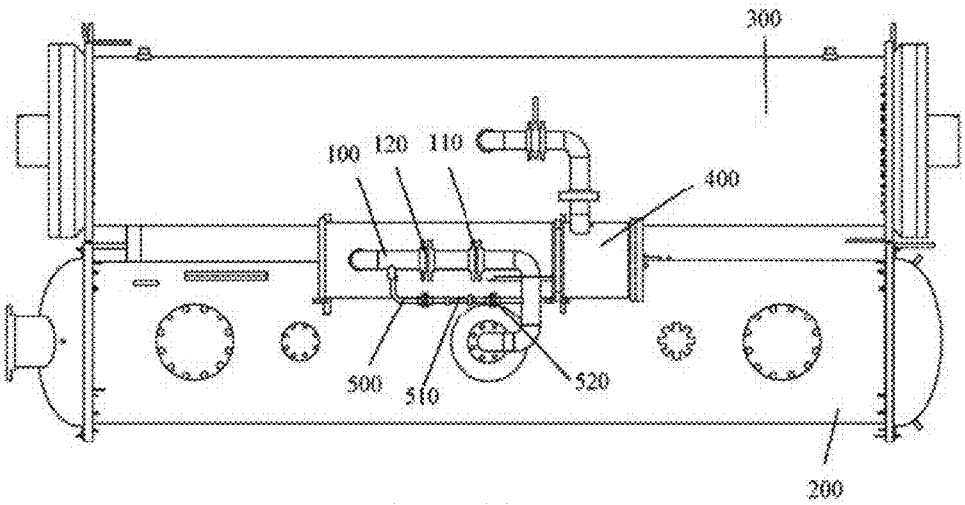
FIG. 5 is a schematic diagram showing the arrangement of a refrigeration system according to another embodiment of the present invention.

Referring to FIGS. 4 and 5, another embodiment of the present invention is shown. Compared with the previous embodiment, the refrigeration system is further provided with a filter 520 at the upstream of the electronic expansion valve 510, and the filter 520 is also arranged in the bypass flow path 500, to filter off the impurities.

Moreover, in the refrigeration system of the above embodiment, the liquid level sensor is disposed in a liquid reservoir beneath the condenser 200, to detect the liquid level of a refrigerant present upstream of the throttle flow path 100, and the controller determines the opening of the auxiliary throttle element in the bypass flow path 500 according to the practical accumulation of the refrigerant. Particularly, in a control embodiment, when the accumulated liquid level is high, a large opening of the auxiliary throttle element is required; and when the accumulated liquid level is low, a small opening of the auxiliary throttle element is required. Even when the accumulated liquid level is much lower, the opening of the auxiliary throttle element is required to be decreased gradually. In a control embodiment, when the refrigerant is accumulated at a high liquid level for a long period of time, a large opening of the auxiliary throttle element is required; and when the refrigerant is accumulated at a high liquid level for a short period of time, a small opening of the auxiliary throttle element is required. Even when the refrigerant is accumulated at a low liquid level for a period of time, the opening of the auxiliary throttle element needed is required to be decreased gradually. All the modes of control are taken into account herein, and detailed description will be made hereinafter with reference to FIGS. 6 to 8. Optionally, it can also be known from the concept of the present invention that if the liquid level sensor is disposed in the economizer, to detect the liquid level of the refrigerant present downstream of the throttle flow path 100, the control for the opening of the auxiliary throttle element in the bypass flow path 500 can also be achieved. For example, in a control embodiment, when the accumulated liquid level in the economizer is low, a large opening of the auxiliary throttle element is required; and when the accumulated liquid level is high, a small opening of the auxiliary throttle element is required.

Figure 6:
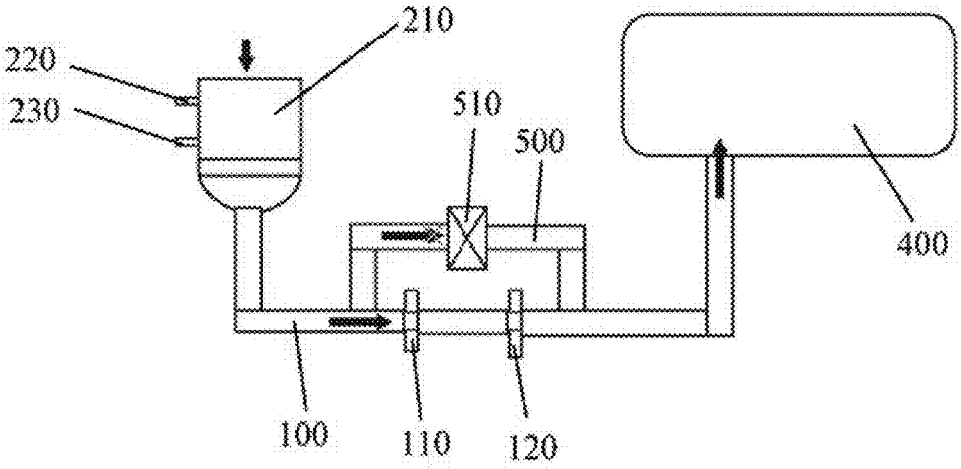
FIG. 6 is a schematic diagram showing the flow of a refrigerant in a refrigeration system of the present invention when an auxiliary throttle element is closed.
Figure 7:
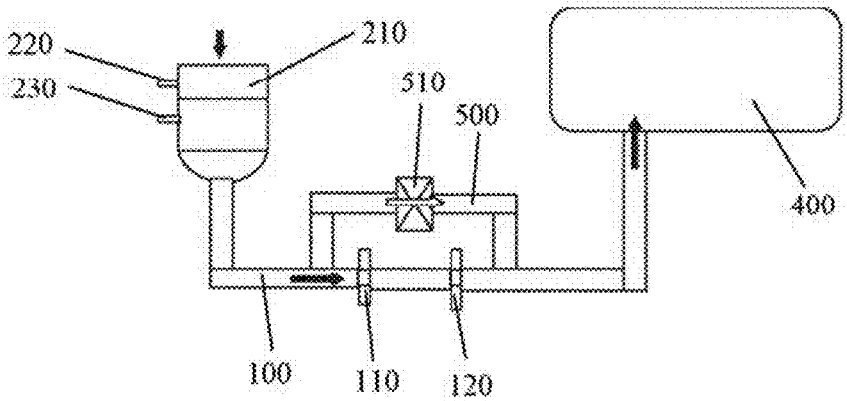
FIG. 7 is a schematic diagram showing the flow of a refrigerant in a refrigeration system of the present invention when an auxiliary throttle element is kept open.
Figure 8:
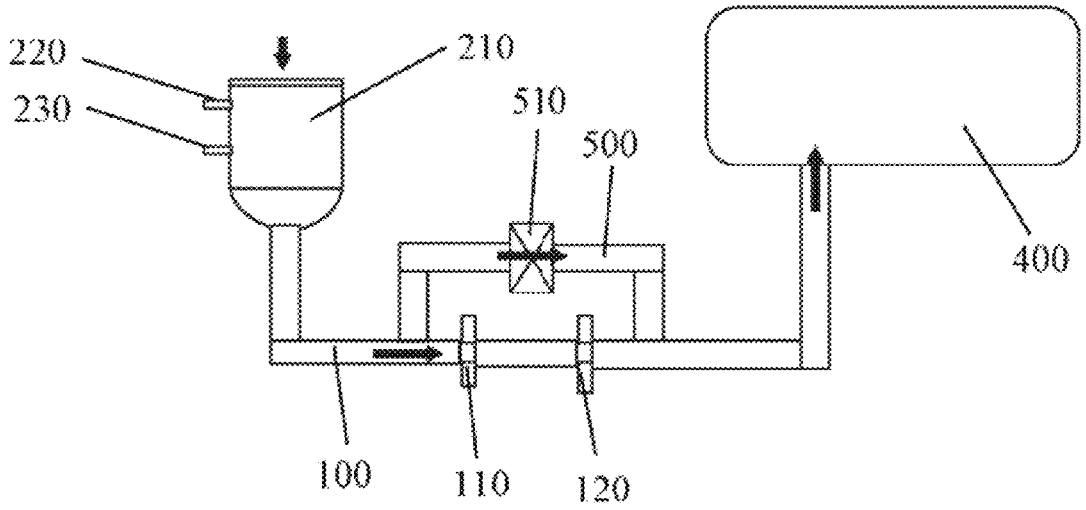
FIG. 8 is a schematic diagram showing the flow of a refrigerant in a refrigeration system of the present invention when the opening of an auxiliary throttle element is increased.

Referring to FIGS. 6 to 8, on one hand, some details of the refrigeration system are further illustrated; on the other hand, different working conditions of the refrigeration system are also illustrated.

Particularly, the throttle flow path 100 is connected to an outlet of a liquid reservoir 210 beneath the condenser 200 at the upstream, and to an inlet of the economizer 400 at the downstream. Moreover, a liquid level sensor is disposed in the liquid reservoir 210, and configured to detect the level of a refrigerant accumulated in the liquid reservoir 210. When the level is below a threshold, it is suggested that the throttle area in the throttle flow path is sufficient to meet the current working condition, and thus the electronic expansion valve 510 in the auxiliary flow path 500 is kept closed. When the level is at a threshold, it is suggested that the throttle area in the throttle flow path is insufficient to meet the current working condition, but there is no need for immediate adjustment. Therefore, the current opening of the electronic expansion valve 510 in the auxiliary flow path 500 is maintained. If the situation is ameliorated, then the liquid accumulated in the liquid reservoir 210 returns to be in the above situation; and if the situation is exacerbated, then the electronic expansion valve 510 in the auxiliary flow path 500 needs to be opened to have some opening for amelioration.

More specifically, two liquid level sensors, that is, a first liquid level sensor 220 disposed at a first height of the liquid reservoir 210 and a second liquid level sensor 230 disposed at a second height of the liquid reservoir 210, are used in the refrigeration system. In this case, when the liquid level is below the second height indicated by the second liquid level sensor 230, it is suggested that the throttle area in the throttle flow path is sufficient to meet the current working condition. Therefore, the electronic expansion valve 510 in the auxiliary flow path 500 is kept closed, as shown in FIG. 6. When the liquid level is between the second height indicated by the second liquid level sensor 230 and the first height indicated by the first liquid level sensor 220, it is suggested that the throttle area in the throttle flow path is insufficient to meet the current working condition, but there is no need for immediate adjustment. Therefore, the current opening of the electronic expansion valve 510 in the auxiliary flow path 500 is maintained, as shown in FIG. 7. If the situation is ameliorated, then the liquid accumulated in the liquid reservoir 210 returns to be in the situation as shown in FIG. 6; and if the situation is being exacerbated till the liquid level is above the first height indicated by the first liquid level sensor 220, then the electronic expansion valve 510 in the auxiliary flow path 500 needs to be opened to have some opening for amelioration, as shown in FIG. 8. The description here is made only for the mechanism of control of the refrigeration system based on the first liquid level sensor 220 and the second liquid level sensor 230, and a specific control method will be described in detail hereinafter.

Optionally, after experiments, the present invention provides an optional implementation of a specific position for disposing the liquid level sensor. For example, the first liquid level sensor 220 is disposed at ⅔ of the height of the liquid reservoir 210, and the second liquid level sensor 230 is disposed at ⅓ of the height of the liquid reservoir 210.

Based on the same mechanism, it can be known that the present solution may also be implemented by disposing the two liquid level sensors in a liquid reservoir of the economizer located downstream of the flow path. Apparently, when the liquid is largely accumulated at the upstream, few liquid will be accumulated at the downstream; and vice versa. Therefore, the present invention can also be accomplished through reverse manipulation of the control above according to the liquid level signal fed back.

More specifically, the two liquid level sensors includes a first liquid level sensor disposed at a first height of the liquid reservoir of the economizer and a second liquid level sensor disposed at a second height of the liquid reservoir. In this case, when the liquid level is below the second height indicated by the second liquid level sensor, it is suggested that the throttle area in the throttle flow path is insufficient to meet the current working condition. Therefore, the electronic expansion valve in the auxiliary flow path needs to be opened to have some opening for amelioration. When the liquid level is between the second height indicated by the second liquid level sensor and the first height indicated by the first liquid level sensor, it is suggested that the throttle area in the throttle flow path is insufficient to meet the current working condition, but there is no need for immediate adjustment. Therefore, the current opening of the electronic expansion valve in the auxiliary flow path is maintained. If the situation is ameliorated, then the liquid accumulated in the liquid reservoir will rise to a liquid level that is above the first height indicated by the first liquid level sensor. In this case, the electronic expansion valve in the auxiliary flow path is kept closed. If the situation is being exacerbated, then the operation proceeds back to the first step. The description here is made only for the mechanism of control of the refrigeration system based on the first liquid level sensor and the second liquid level sensor, and a specific control method will be described in detail hereinafter.

Optionally, after experiments, the present invention provides an optional implementation of a specific position for disposing the liquid level sensor. For example, the first liquid level sensor is disposed at ⅔ of the height of the liquid reservoir, and the second liquid level sensor is disposed at ⅓ of the height of the liquid reservoir.

The present invention further provides a throttle control method for the refrigeration system above, including essentially the steps of S100: receiving a liquid level signal from a liquid level sensor; S200: comparing the liquid level signal with a preset value of the system, and outputting a control signal; and S300: controlling the opening of an auxiliary throttle element according to the control signal.

Based on the above steps, the basic control for the opening of the adjustable auxiliary throttle element of the present invention can be realized. On basis of this, the present invention provides further improvements on the method, to achieve a better technical effect.

By way of example, the preset value of the system mentioned above may include a first liquid level and a second liquid level. When the liquid level sensor is arranged upstream of the throttle flow path, the step S300 is further improved by including S310: increasing the opening of the auxiliary throttle element when the liquid level is above the first liquid level; S320: maintaining the current opening of the auxiliary throttle element when the liquid level is between the first liquid level and the second liquid level; or S330: decreasing the opening of the auxiliary throttle element when the liquid level is below the second liquid level.

In this embodiment of the method, the adjustment process is refined. Only when the current liquid level is determined to be above the first liquid level, the controller considers that the refrigeration system is currently under a working condition that requires increasing the throttle area, and then increases the opening of the auxiliary throttle element; and only when the current liquid level is determined to be below the second liquid level, the controller considers that the refrigeration system is currently under a normal working condition, and then decreases the opening of the auxiliary throttle element. When the current liquid level is determined to be between the first liquid level and the second liquid level, the system is considered to be currently in a middle state, so the current opening is maintained to provide a buffering effect. This middle state is such that the liquid level continuously declines with the current opening, or the liquid level continuously rises with the current opening, depending on the specific working scenario.

In addition, the control in two extreme scenarios is also considered in this embodiment, to perfect and complete the present method. In a first scenario, S310 further includes: judging the state of opening of the auxiliary throttle element when the liquid level is above the first liquid level; increasing the opening of the auxiliary throttle element if the opening of the auxiliary throttle element is less than 100%; and maintaining the current opening of the auxiliary throttle element if the opening of the auxiliary throttle element equals to 100%. In a second scenario, S330 further includes: judging the state of opening of the auxiliary throttle element when the liquid level is below the second liquid level; decreasing the opening of the auxiliary throttle element if the opening of the auxiliary throttle element is greater than 0; and maintaining the current opening of the auxiliary throttle element if the opening of the auxiliary throttle element equals to 0. By means of the above steps, the issue of some unable-to-perform commands to the system is avoided when an intended effect cannot be achieved through the adjustment of the throttle area of the bypass flow path in the refrigeration system due to the occurrence of some extreme working conditions. In this manner, the throttle control method of the present invention is further perfected.

When the liquid level sensor is disposed downstream of the throttle flow path, the step S300 is further improved by including S310: decreasing the opening of the auxiliary throttle element when the liquid level is above the first liquid level; S320: maintaining the current opening of the auxiliary throttle element when the liquid level is between the first liquid level and the second liquid level; or S330: increasing the opening of the auxiliary throttle element when the liquid level is below the second liquid level.

In this embodiment of the method, the adjustment process is refined, and the mode of control is contrary to that employed when the liquid level sensor is arranged at the upstream. That is, only when the current liquid level is determined to be below the second liquid level, the controller considers that the refrigeration system is currently under a working condition that requires increasing the throttle area, and then increases the opening of the auxiliary throttle element; and only when the current liquid level is determined to be above the first liquid level, the controller considers that the refrigeration system is currently under a normal working condition, and then decreases the opening of the auxiliary throttle element. When the current liquid level is determined to be between the first liquid level and the second liquid level, the system is considered to be currently in a middle state, so the current opening is maintained to provide a buffering effect. This middle state is such that the liquid level continuously declines with the current opening, or the liquid level continuously rises with the current opening, depending on the specific working scenario.

In addition, the control in two extreme scenarios is also considered in this embodiment, to perfect and complete the present method. In a first scenario, S310 further includes: judging the state of opening of the auxiliary throttle element when the liquid level is above the first liquid level; decreasing the opening of the auxiliary throttle element if the opening of the auxiliary throttle element greater than 0; and maintaining the current opening of the auxiliary throttle element if the opening of the auxiliary throttle element equals to 0. In a second scenario, S330 further includes: judging the state of opening of the auxiliary throttle element when the liquid level is below the second liquid level; increasing the opening of the auxiliary throttle element if the opening of the auxiliary throttle element is less than 100%; and maintaining the current opening of the auxiliary throttle element if the opening of the auxiliary throttle element equals to 100%. By means of the above steps, the issue of some unable-to-perform commands to the system is avoided when an intended effect cannot be achieved through the adjustment of the throttle area of the bypass flow path in the refrigeration system due to the occurrence of some extreme working conditions. In this manner, the throttle control method of the present invention is further perfected.

For the purpose of simplifying the programming of the controller and increasing the stability of a closed control loop, every control for increasing the opening or decreasing the opening of the auxiliary throttle element may be by a fixed increment herein. For example, the opening of the auxiliary throttle element is increased by a first opening at each time; or the opening of the auxiliary throttle element is decreased by a second opening at each time. Likewise, after experiments, the present invention provides an optional implementation in which the first opening is 3%, and/or the second opening is 3%.

Optionally, the aforesaid method of the present invention may be further improved. That is, a step S400 of maintaining the step S300 for a first period of time is included after the step S300. This is because the operation and adjustment of the system is a continuous process, and the instant adjustment of the liquid accumulated in the liquid reservoir 210 of the system cannot be realized after adjusting the opening of the auxiliary throttle element. Therefore, the process is maintained for a first period of time, such that the effect of S300 can be further embodied. Similarly, after experiments, the present invention provides an optional implementation in which the first period of time is 5 s.

Hereinafter, a throttle control process of the present invention obtained by combining the advantages of the methods above where the liquid level sensor is arranged in the liquid reservoir 210 of the condenser 200 located upstream of the throttle flow path is described with reference to FIGS. 6 to 8.

When the refrigeration system operates normally, if the refrigerant accumulated in the liquid reservoir 210 is below the first liquid level sensor 220 and the second liquid level sensor 230 disposed in the liquid reservoir 210, both the first liquid level sensor 220 and the second liquid level sensor 230 transmit a "NO" signal to the controller. The controller compares the two "NO" signal with a preset value of the system, and determines that the liquid level of the refrigerant in the liquid reservoir 210 is below the second liquid level at this time, and thus assumes that the throttle area in the throttle flow path 100 is sufficient to meet the current working condition. In this case, the electronic expansion valve 510 in the auxiliary flow path 500 is detected. If the opening of the electronic expansion valve 510 is greater than 0, the opening of the auxiliary throttle element is decreased by 3%; and if the opening of the auxiliary throttle element 510 equals to 0, the electronic expansion valve 510 is maintained closed. The current control is maintained for 5 s. Then, the process proceeds to a next cycle of detection.

If the refrigerant accumulated in the liquid reservoir 210 is detected to be below the first liquid level sensor 220 disposed in the liquid reservoir 210, but above the second liquid level sensor 230 disposed in the liquid reservoir 210, the first liquid level sensor 220 and the second liquid level sensor 230 transmit a "NO" and a "YES" signal to the controller respectively. The controller compares the signals with a preset value of the system, and determines that the liquid level of the refrigerant in the liquid reservoir 210 is above the second liquid level and below the first liquid level at this time, and thus assumes that although the throttle area in the throttle flow path 100 is insufficient to meet the current working condition, there is no need for immediately increasing the throttle area, and a buffer period may be provided first. In this case, the current opening of the electronic expansion valve 510 is maintained. The current control is maintained for 5 s. Then, the process proceeds to a next cycle of detection.

If the refrigerant accumulated in the liquid reservoir 210 is detected to be above the first liquid level sensor 220 and the second liquid level sensor 230 disposed in the liquid reservoir 210, both the first liquid level sensor 220 and the second liquid level sensor 230 transmit a "YES" signal to the controller. The controller compares the two "YES" signal with a preset value of the system, and determines that the liquid level of the refrigerant in the liquid reservoir 210 is above the second liquid level at this time, and thus assumes that the throttle area in the throttle flow path 100 is insufficient to meet the current working condition. In this case, the electronic expansion valve 510 in the auxiliary flow path 500 is detected. If the opening of the electronic expansion valve 510 is less than 100%, the opening of the auxiliary throttle element 510 is increased by 3%; and if the opening of the auxiliary throttle element 510 equals to 100%, the auxiliary throttle element is maintained fully open. The current control is maintained for 5 s. Then, the process proceeds to a next cycle of detection.

In the description of the present invention, it should be understood that the direction or position relationships indicated by "on", "under", "front", "rear", "left", "right", and the like are direction or position relationships based on the accompanying drawings, and are only used to facilitate and simplify the description of the present invention, rather than to indicate or imply that the discussed apparatuses or features must be in specific directions and be built and operated in specific directions. Therefore, the direction or position relationships should not be construed as a limitation to the present invention.

The refrigeration system and throttle control method therefor of the present invention are mainly described by using the foregoing examples. Although only some implementations of the present invention are described, it should be understood by a person of ordinary skill in the art that the present invention may be implemented in many other forms without departing from the spirit and scope of the present invention. Therefore, the presented examples and implementations are regarded to be illustrative rather than limitative, and the present invention may cover various changes and replacements without departing from the spirit and scope of the present invention as defined by the appended claims.

What is claimed is:

1. A throttle control method for a refrigeration system comprising:

a compressor, a condenser, a throttle flow path, and an evaporator connected in sequence;

wherein a non-adjustable main throttle element is disposed in the throttle flow path;

a bypass flow path, wherein the bypass flow path is connected to the throttle flow path respectively at the upstream and downstream of the main throttle element, and provided with an adjustable auxiliary throttle element thereon;

a liquid level sensor, disposed upstream and/or downstream of the throttle flow path, and configured to detect the liquid level; and a controller, wherein the controller is configured to control the opening of the auxiliary throttle element according to a liquid level signal from the liquid level sensor;

the method comprising:

S100: receiving a liquid level signal from a liquid level sensor;

S200: comparing the liquid level signal with a preset value of the system, and outputting a control signal; and S300: controlling the opening of the adjustable auxiliary throttle element according to the control signal;

wherein controlling the opening of the adjustable auxiliary throttle element includes increasing the opening of the adjustable auxiliary throttle element when flow through the main throttle element is not sufficient to meet a current working condition.

2. The throttle control method according to claim 1, wherein the preset value of the system comprises a first liquid level and a second liquid level, and when the liquid level sensor is arranged upstream of the throttle flow path, S300 comprises:

S310: increasing the opening of the auxiliary throttle element when the liquid level is above the first liquid level; or S320: maintaining the current opening of the auxiliary throttle element when the liquid level is between the first liquid level and the second liquid level; or S330: decreasing the opening of the auxiliary throttle element when the liquid level is below the second liquid level.

3. The throttle control method according to claim 2, wherein S310 further comprises: judging the state of opening of the auxiliary throttle element when the liquid level is above the first liquid level; increasing the opening of the auxiliary throttle element if the opening of the auxiliary throttle element is less than 100%; and maintaining the current opening of the auxiliary throttle element if the opening of the auxiliary throttle element equals to 100%.

4. The throttle control method according to claim 2, wherein S330 further comprises: judging the state of opening of the auxiliary throttle element when the liquid level is below the second liquid level; decreasing the opening of the auxiliary throttle element if the opening of the auxiliary throttle element is greater than 0; and maintaining the current opening of the auxiliary throttle element if the opening of the auxiliary throttle element equals to 0.

5. The throttle control method according to claim 1, wherein the preset value of the system comprises a first liquid level and a second liquid level, and when the liquid level sensor is arranged downstream of the throttle flow path, S300 comprises:

S310: decreasing the opening of the auxiliary throttle element when the liquid level is above the first liquid level; or S320: maintaining the current opening of the auxiliary throttle element when the liquid level is between the first liquid level and the second liquid level; or S330: increasing the opening of the auxiliary throttle element when the liquid level is below the second liquid level.

6. The throttle control method according to claim 5, wherein S310 further comprises: judging the state of opening of the auxiliary throttle element when the liquid level is above the first liquid level; decreasing the opening of the auxiliary throttle element if the opening of the auxiliary throttle element is greater than 0; and maintaining the current opening of the auxiliary throttle element if the opening of the auxiliary throttle element equals to 0.

7. The throttle control method according to claim 5, wherein S330 further comprises: judging the state of opening of the auxiliary throttle element when the liquid level is below the second liquid level; increasing the opening of the auxiliary throttle element if the opening of the auxiliary throttle element is less than 100%; and maintaining the current opening of the auxiliary throttle element if the opening of the auxiliary throttle element equals to 100%.

8. The throttle control method according to claim 2, wherein the opening of the auxiliary throttle element is increased by a first opening at each time; or the opening of the auxiliary throttle element is decreased by a second opening at each time.

9. The throttle control method according to claim 8, wherein the first opening is 3%, and/or the second opening is 3%.

10. The throttle control method according to claim 1, after S300, further comprising S400: maintaining the step S300 for a first period of time.

11. The throttle control method according to claim 10, wherein the first period of time is 5 s.

12. A throttle control method for a refrigeration system comprising:

a compressor, a condenser, a throttle flow path, and an evaporator connected in sequence;

a non-adjustable main throttle element disposed in the throttle flow path;

an economizer, wherein the throttle flow path is connected between the condenser and the economizer or connected between the economizer and the evaporator;

a bypass flow path, wherein the bypass flow path is connected to the throttle flow path respectively at the upstream and downstream of the main throttle element, and provided with an adjustable auxiliary throttle element thereon;

at least one liquid level sensor, disposed upstream or downstream of the throttle flow path, and configured to detect the liquid level, wherein the least one liquid level sensor is disposed in a liquid reservoir; and wherein the liquid reservoir is positioned at an outlet of the condenser, the throttle flow path is positioned at an outlet of the liquid reservoir and the economizer is positioned at an outlet of the throttle flow path;

the method comprising:

S100: receiving a liquid level signal from a liquid level sensor;

S200: comparing the liquid level signal with a preset value of the system, and outputting a control signal; and

S300: controlling the opening of an auxiliary throttle element according to the control signal.

* * * * *